United States Patent [19]

Dollar, Jr. et al.

[11] Patent Number: 4,789,160

[45] Date of Patent: Dec. 6, 1988

[54] GOLF SWING POSITION INDICATOR

[76] Inventors: William O. Dollar, Jr., 804 Oakridge Dr., Birmingham, Ala. 35214; Kenneth D. Smith, 2750 Stickney Point Rd., Sarasota, Fla. 33581

[21] Appl. No.: 707,158

[22] Filed: Jul. 8, 1987

Related U.S. Application Data

[63] Continuation of Ser. No. 804,418, Dec. 4, 1985, abandoned.

[51] Int. Cl.[4] ..... A63B 69/36; A63B 69/38

[52] U.S. Cl. ..... 273/186 A; 273/26 B; 273/29 A

[58] Field of Search ..... 273/54 B, 186 R, 186 A, 273/183 R, 183 B, 183 D, 26 C, 26 B, 29 A, 73 R

[56] References Cited

U.S. PATENT DOCUMENTS

| | | | |
|---|---|---|---|
| 3,766,538 | 10/1973 | Dealy | 273/26 C X |
| 3,788,647 | 1/1974 | Evans | 273/186 A X |
| 4,094,504 | 6/1978 | Barasch | 273/186 A X |
| 4,330,123 | 5/1982 | Kleinerman | 273/54 B |
| 4,515,368 | 5/1985 | Petitjen | 273/186 A |
| 4,535,986 | 8/1985 | Richards | 273/73 J X |

*Primary Examiner*—Maryann Lastova

*Attorney, Agent, or Firm*—Mitchell B. Wasson; Raphael V. Lupo; Martin P. Hoffman

[57] ABSTRACT

A device for insuring that the striking surface of a sports implement is properly oriented prior to the initiation and completion of a contact swing. Two position orientation sensors are affixed to the shaft of the sports implement. One sensor senses the roll position of the striking surface, and the second sensor senses the pitch position of the striking surface. When both of these sensors indicate that the striking surface is properly oriented, an audible signal is generated. This signal is maintained for as long as the striking surface is properly oriented.

12 Claims, 2 Drawing Sheets

GOLF SWING POSITION INDICATOR

This application is a continuation of application Ser. No. 804,418, filed Dec. 4, 1985, now abandoned.

BACKGROUND OF THE INVENTION

1. Field of the Invention

This invention relates in general to a sport training aid, and is particularly well suited for use with a golf club to improve the angle and position of the club at the top of the golfer's backswing. Likewise, the device could similarly be used in any sport where a particular position is preferred prior to the completion of the swing including tennis and baseball. For purposes of illustration, the invention will be described herein as it is used for the game of golf. The device is preferably attached to the shaft of the club at a point compatible with the balance of the club and responds to the pitch and roll of the shaft at the desired position at the top of the backswing, to give an audible sound only when the desired position is achieved and maintained.

2. Description of the Prior Art

In many sports, such as tennis or golf, it is extremely important for the athlete to develop proper position of the hands and body prior to completion on the contact stroke, so as to achieve maximum result. For example, in golf success is particularly dependent upon the player's ability to execute the proper swing. Although there are many theories as to how to achieve an effective golf swing, it is generally accepted that in each there is a proper positioning of the club head at the top of the backswing that will facilitate the correct forward swing. In golf, for example, for many years the recognized authorities on teaching the proper use of the golf club have agreed that there is a well defined, correct position that should be obtained at the top of the backswing and would be the position from which the forward swing originates. This has been referred to as the "classic position" and is more particularly defined at the top of the backswing when the shaft of the golf club is parallel with the ground and the leading edge of the club head is rotated 45 degrees below the horizontal. When this proper angle of the club head is achieved, the golfer has what is referred to by professional golf instructors as a "firm wrist", meaning that there is a straight line simulated by the back of the golfer's hand extending through the wrist and forearm. If the wrist is either cupped or broken, the club head will not be at the proper 45 degree rotation that is required for a correct position at the top of the backswing.

In golf, as in many sports, it is important that the player be professionally instructed whereby the player may initially learn what constitutes an effective and proper position of body, hands, club and stance so that the contact implement is in a proper position to begin and complete the swing to make proper contact with the ball. In this way the instructor can observe the player and adjust the position of the hands, wrists, arms and body to secure the proper implement alignment. However, to consistently achieve this position and execute the proper swing, it is important that the player execute consistently the same position and swing. Constant supervision by a professional during either practice or play is not usually possible due to cost and availability. For those times when professional instruction is not utilized, there is a need for a training device capable of detecting and indicating when the proper position just prior to the forward swing has been achieved.

Prior art devices used to improve an athlete's swing have in large part been concerned with the speed, momentum or angle of the implement while it is being swung rather than the position of backswing. Examples of these are U.S. Pat. Nos. 4,094,504, Barasch, 3,848,873, Linning and 4,515,368 Petitjean. In golf, prior art devices have been described which require a connection between the golf club and a portion of the athlete's body or between an attachment to the golf club and a part of the golfer's body during a substantial portion of the swing See U.S. Pat. No. 4,170,356, Banks. These devices, however, have drawbacks. Any such device would likely interfere with the natural swing pattern of the golfer and fail to take into account the body position of the golfer which may, in turn, affect the quality of the swing. For example, in U.S. Pat. No. 4,170,356, the rod 18 in FIG. 3 may touch the golfer at the time of backswing, but it in no way prevents an improper dip in the shoulder or other body misplacement. Further, various prior art devices have been designed to be placed near the head of the implement, thus significantly changing the swing weight of the implement. See U.S. Pat. No. 3,848,873, Linning. Oftentimes it is necessary for an experienced golfer to first observe and work with the athlete to pre-set the devices so that the proper swing is indicated by the device.

It is the general aim of the present invention to provide an athletic swing training device which acts independently of any contact with the athlete's body, requires no supervision by an expert, and which emits an audible sound to the athlete when he has placed the club, bat or racquet in the correct position at the end of the backswing. The electrical device includes a battery, sound emitting device, switch housing and two attitude switches.

OBJECTS OF THE INVENTION

Accordingly, it is an object of the invention to overcome one or more of the above-mentioned limitations of the prior art.

It is another object of this invention to provide the athlete with a device that is quickly and easily attached to the sports implement to monitor the athlete's performance so as to inform the athlete that the implement is in the correct position prior to initiation and completion of the forward swing.

It is another object of this invention to provide the athlete with a training device that may be attached to the athletic equipment near the grip so as to be nearly imperceptible by the athlete during practice.

It is yet another object of the invention to provide the athlete with a training device for use in a restricted area where it is impossible to permit the hitting of a ball to determine whether or not the athlete is achieving the correct position at the top of the swing.

It is also an object of the invention to allow the athlete to pause at the top of his swing and independently adjust the pitch and roll of the sports implement to develop a feel or muscle memory for the correct position before following through with the forward swing.

It is an object of the invention to provide a swing training device that is sturdy enough to allow the user to execute the swing during practice and then without noticing any difference in swing weight or balance, remove the device enabling the player to transfer the skill to normal playing conditions.

Another object of the invention is to provide the athlete with a training device which may, if desired, be pre-set to sound at the attainment of a desired position, when the sport involved allows for variations in the position of the sports implement.

It is yet another object of the invention to provide a device, use of which will tend to naturally make the player slow the backswing in anticipation of the audible signal.

It is also an object of the invention to provide a device which is easily transferable to any club within a player's set to enable him to develop his skills with each club.

DESCRIPTION OF THE PREFERRED EMBODIMENTS

Figure 1:
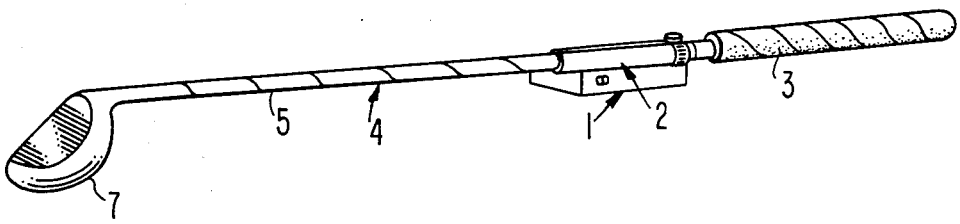
FIG. 1 is an illustration of the device as it is attached to a golf club.

While the invention is susceptible to various modifications and alternative constructions, illustrative embodiments have been shown in the drawings and will be described in detail. It should be understood, however, that there is no intention to limit the invention to the specific form described, but on the contrary, the intention is to cover all modifications, alternative constructions, and equivalents falling within the scope of the appended claims.

Figure 2:
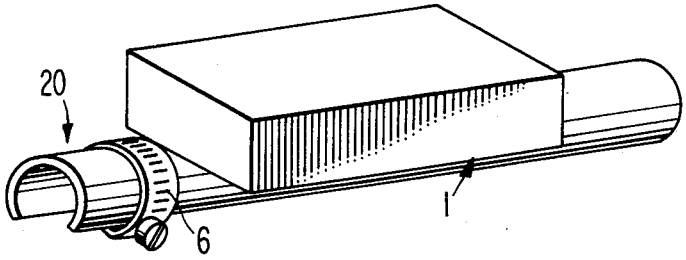
FIG. 2 is a view of the device enclosure and mount.

Turning to FIGS. 1 and 2, a housing 1 of a device 2 is attached to a golf club 5 near the bottom of the grip 3 and on the shaft 4. Club 5 is illustrated as a driver, but could be any golf club. Locating the device on the club as close as possible to the grip 3 minimizes any effect the device has on the swing weight of the club and ensures that the skills developed by practicing with this device are readily duplicated when using the golf club with the device removed. As indicated in FIG. 2, the means for mounting the device may be a hollow, half cylindrical jacket 20 which is attached to the housing and which fits over the shaft. The clamp 6 prevents the device from moving along the shaft 4 toward the head 7 of the golf club 5 due to the centrifugal force generated parallel to the shaft 4 when the golf club 5 is swung by the golfer. The clamp 6 also allows the device to be removed and secured at will such as to use on another golf club.

Figure 3:
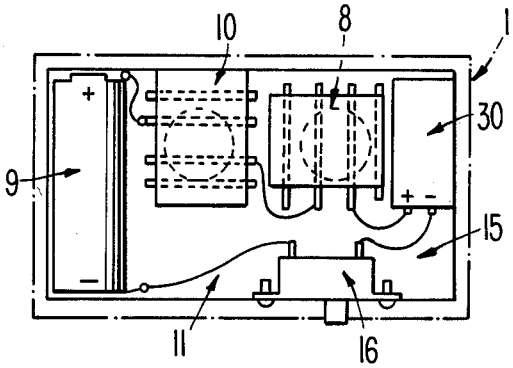
FIG. 3 is a plan view of the indicator, showing the circuit and arrangement of two attitude switches, a battery and a sound emitting device.

As shown in FIG. 3, the housing 1 holds a power source 9, such as a low voltage battery, connected to an electrical circuit 11. Within the electrical circuit are two attitude switches 8, 10; switch 8 responds to the pitch of the club and switch 10 responds to the roll of the club while poised at the top of the backswing. Under most circumstances, these switches remain disengaged and the circuit open. The circuit is connected to an audible signal device 30 such as a buzzer or beeper. An additional switch 16 turns the device off and on. These components are secured to a base, such as lightweight wood or perforated peg board 15. When the proper position is attained at the top of the backswing, the two attitude switches 8, 10 are engaged, completing the circuit to sound the signal. In the golf backswing, for example, when the shaft of the golf club 4 is level, and the leading edge of the club head 7 is rotated 45 degrees below the horizontal, the alarm will sound.

Figure 4:
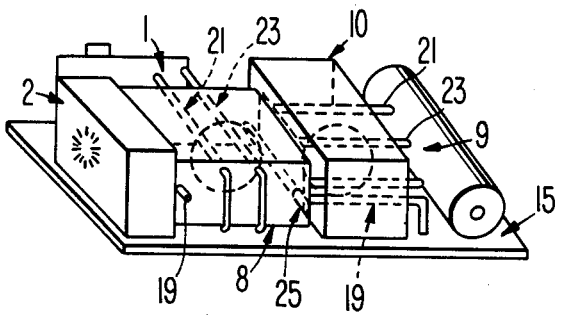
FIG. 4 is a side view of the indicator.
Figure 5:
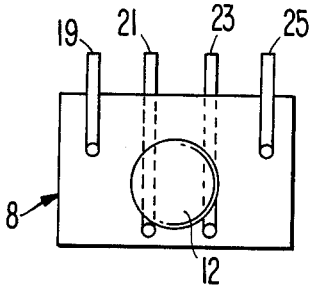
FIG. 5 is a detailed plan view of a single attitude switch as housed in its enclosure with wire contacts and a ball.

The attitude switches are illustrated in further detail in FIGS. 4 and 5. Each switch comprises a housing or cage, four metal contacts 19, 21, 23, 25 and a metal plated ball 12. Only the two middle metal contacts 21 and 23 are electrically connected while contacts 19 and 25 are only used to physically restrain the rolling ball from undesirable movement. Contacts 19 and 25 are dead externally to the housing. The ball 12 is freely rollable within the enclosure except its constraint by the four metallic contacts. Upon attainment of the correct position of the backswing, the metal ball in each enclosure contacts the two center metal contacts 21 and 23 to complete the circuit. Since both attitude switches are connected in series, an audible sound will only occur when both attitude switches are completed thereby indicating proper pitch and roll positions. This arrangement allows that, should the correct position not be immediately attained, the golfer may pause at the top of his backswing and adjust the angle of the club shaft and the rotation of the club head until the correct position is reached, bringing the balls simultaneously into contact with the metal contacts, completing the circuit. The device will then emit a continuous audible signal as long as the position is maintained. The golfer may then complete the backswing with the assurance of having obtained the classic position prior to forward swing.

Figure 6:
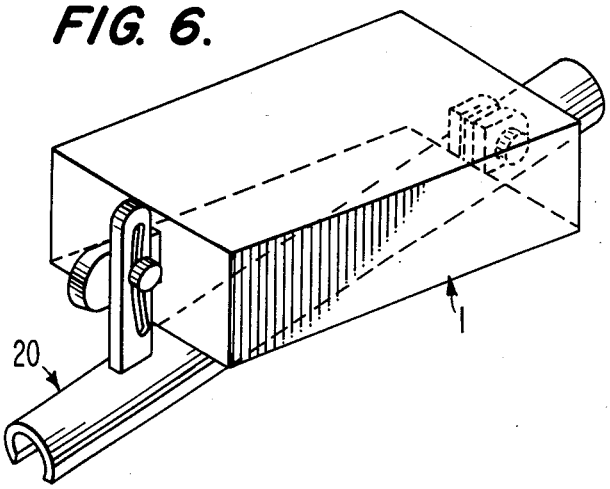
FIG. 6 is a view of a possible bracket arrangement that would allow for varying the desirable angle of the pitch and roll.

While the preferred embodiments have been described in connection with a golf club, it is apparent that this device can be used in connection with other sports such as tennis or baseball, where a racquet, bat or the like is used to strike a ball. To allow for such use, where the required pitch and roll of the sports implement may vary, the device shown in FIG. 6 allows for adjustment of the required pitch of the equipment. Of course, a similar device may allow for adjustment of the roll of the equipment.

What is claimed is:

1. A device for use with a sports implement provided with a striking surface and a shaft for determining the proper orientation of the striking surface at the completion of the backswing of the sports implement, said device comprising:

a housing adapted to be attached to said shaft of the sports implement; and a sensing circuit provided within said housing for sensing the orientation of the striking surface of the sports implement, said sensing circuit comprising:

a source of power;

a first position sensing means connected to said source of power for sensing the roll position of the striking surface;

a second position sensing means connected to said source of power for sensing the pitch position of the striking surface; and signal means connected to said source of power and said first and second position sensing means for emitting a signal when both said first and second position sensing means indicate that the striking surface is in its proper orientation, said signal emitted when the sports implement is at rest after completion of the backswing but prior to the initiation of the swing of the sports implement, wherein the striking surface is repositioned after the completion of the backswing until said signal means emits a signal.

2. The device in accordance with claim 1 wherein said signal means produces an audible signal when the striking surface is properly oriented.

3. The device in accordance with claim 1 wherein said signal device emits a continuous signal whenever and as long as said first and second position sensing means indicate that the striking surface is in its proper orientation.

4. The device in accordance with claim 1 wherein each of said first and second position sensing means is provided with a switch consisting of:

an enclosure;

two energizable wire contacts provided within said enclosure; and a movable metal ball provided within said enclosure, wherein each of said balls moves within its respective enclosure and comes into contact with its respective wire contacts when said striking surface is properly oriented.

5. The device in accordance with claim 1 wherein said first position means and said second position means are electrically connected in series.

6. The device in accordance with claim 1 wherein said housing is angularly adjustable on the shaft of said sports implement.

7. A device in combination with a golf club provided with a striking surface and a shaft for determining the proper orientation of the striking surface at the completion of the backswing of the golf club, said device and golf club comprising:

a housing attached to the shaft of the golf club; and a sensing circuit provided within said housing for sensing the orientation of the striking surface of the golf club, said sensing circuit comprising:

a source of power;

a first position sensing means connected to said source of power for sensing the roll position of the striking surface;

a second position sensing means connected to said source of power for sensing the pitch position of the striking surface; and signal means connected to said source of power and said first and second position sensing means for emitting a signal when both said first and second position sensing means indicate that the striking surface is in its proper orientation, said signal emitted when the golf club is at rest after completion of the backswing but prior to the initiation of the swing of the golf club, wherein the striking surface is repositioned after the completion of the backswing until said signal means emits a signal.

8. The device and golf club in accordance with claim 7 wherein said signal means produces an audible signal when the striking surface is properly oriented.

9. The device and golf club in accordance with claim 7 wherein said signal device emits a continuous signal whenever and as long as said first and second position sensing means indicate that the striking surface is in its proper orientation.

10. The device and golf club in accordance with claim 7 wherein each of said first and second position sensing means is provided with a switch consisting of:

an enclosure;

two energizable wire contacts provided within said enclosure; and a movable metal ball provided within said enclosure, wherein each of said balls moves within its respective enclosure and comes into contact with its respective wire contacts when the striking surface is properly oriented.

11. The device and golf club in accordance with claim 7 wherein said first position means and said second position means are electrically connected in series.

12. The device and golf club in accordance with claim 7 wherein said housing is angularly adjustable on the shaft of the golf club.

* * * * *

UNITED STATES PATENT AND TRADEMARK OFFICE

CERTIFICATE OF CORRECTION

PATENT NO. : 4,789,160

DATED : DECEMBER 6, 1988

INVENTOR(S) : WILLIAM O. DOLLAR, JR. AND KENNETH D. SMITH

It is certified that error appears in the above-identified patent and that said Letters Patent is hereby corrected as shown below:

On the title page

Change "Appl. No. 707,158" to --Appl. No. 071,580--

Signed and Sealed this

Twentieth Day of June, 1989

*Attest:*

*Attesting Officer*

DONALD J. QUIGG

*Commissioner of Patents and Trademarks*